US005729614A

United States Patent [19]

Nagata et al.

[11] Patent Number: 5,729,614

[45] Date of Patent: Mar. 17, 1998

[54] HOWLING REMOVER COMPOSED OF ADJUSTABLE EQUALIZERS FOR ATTENUATING COMPLICATED NOISE PEAKS

[75] Inventors: Yuichi Nagata; Satoshi Suzuki; Morito Yamada; Masao Yoshida; Mikio Kitano; Kiyoto Kuroiwa; Shigenobu Kimura, all of Hamamatsu, Japan

[73] Assignee: Yamaha Corporation, Hamamatsu, Japan

[21] Appl. No.: 526,261

[22] Filed: Sep. 11, 1995

[30] Foreign Application Priority Data

Sep. 9, 1994 [JP] Japan ..... 6-216292
Apr. 7, 1995 [JP] Japan ..... 7-082459

[51] Int. Cl.[6] ..... H04R 27/00

[52] U.S. Cl. ..... 381/83; 381/93

[58] Field of Search ..... 381/83, 93

[56] References Cited

U.S. PATENT DOCUMENTS 4,064,462 12/1977 Goehler et al. .
4,088,835 5/1978 Thurmond et al. ..... 381/83
4,602,337 7/1986 Cox ..... 381/83
4,845,757 7/1989 Wagner ..... 381/93

FOREIGN PATENT DOCUMENTS 5999450 6/1994 European Pat. Off. .

*Primary Examiner*—Forester W. Isen
*Attorney, Agent, or Firm*—Loeb & Loeb LLP

[57] ABSTRACT

In an apparatus for amplifying a sound while suppressing a howling noise, a microphone collects a sound and converts the collected sound into a corresponding input signal. An amplifier amplifies the input signal to generate the sound through a loudspeaker. A plurality of equalizers are interposed between the microphone and the amplifier, each equalizer having a variable attenuation frequency for attenuatively filtering the input signal around the attenuation frequency. Detection is conducted for detecting a plurality of noise spectrum peaks of the howling noise contained in the collected sound. Then, an adjustment is conducted adjusting respective variable attenuation frequencies of the plurality of the equalizers correspondingly to the plurality of the detected noise spectrum peaks to thereby remove the howling noise from the generated sound.

19 Claims, 9 Drawing Sheets

HOWLING REMOVER COMPOSED OF ADJUSTABLE EQUALIZERS FOR ATTENUATING COMPLICATED NOISE PEAKS

BACKGROUND OF THE INVENTION

The present invention relates to a howling remover of an audio amplifying apparatus for efficiently removing or reducing a howling noise generated in a listening room or the like having a complicated frequency response.

In the audio amplifying apparatus or system concurrently using a microphone and a loudspeaker, a sound generated by the loudspeaker is reflected back by walls of the room, and is then collected by the microphone to thereby generate the howling noise. Thus, the howling remover is required in the audio amplifying system to remove or prevent, the howling noise.

FIG. 11 shows a conventional structure of the howling remover 1. As shown in the figure, a signal generating circuit 10 is provided to generate a white noise having a flat frequency spectrum. A loudspeaker 11 and a microphone 12 are connected to the howling remover 1. A plurality of band pass filters (BPFs) $13_1$–$13_n$ have respective center frequencies which are set, differently from each other. A plurality of peak holding circuits $14_1$–$14_n$ rectify output signals of the corresponding band pass filters $13_1$–$13_n$, and hold respective peaks of the rectified output signals. A selector 15 sequentially selects outputs of the peak holding circuits $14_1$–$14_n$ to feed the selected outputs to an A/D converter 16. A CPU 17 controls operation of the selector 15, and measures each peak value which is digitally converted by the A/D converter 16. Further, a single equalizer circuit 19 and an amplifier circuit 20 are provided in the howling remover 1.

In such a construction of the howling remover 1, switches SW1 and SW2 are placed in an initial state as shown in the figure. The loudspeaker 11 generates the white noise having the flat spectrum throughout an audible frequency range, while the microphone 12 collects a sound. In this situation, the microphone 12 picks up a direct sound transmitted back from the loudspeaker 11 and an indirect sound reflected back from walls or the like of a room. Then, the CPU 17 operates the selector 15 to successively latch and measure the respective peaks outputted from the band pass filters $13_1$–$13_n$. The CPU 17 identifies particular one of the band pass filters $13_1$–$13_n$ or BPF channels, which provides a significant peak exceeding a reference level. Further, the CPU 17 selectively lowers a gain of the equalizer circuit 19 at a frequency band corresponding to the significant peak so as to suppress an output amplitude of the corresponding frequency band. Thereafter, the switches SW1 and SW2 are reversed to a normal state so that an input signal from the microphone 12 is fed to the equalizer circuit 19 while an output signal of the equalizer circuit 19 is fed through the amplifier circuit 20 to the loudspeaker 11 which generates a sound. In this operation, the equalizer circuit 19 has the lowered gain at the band where the howling occurs, thereby suppressing the howling noise contained in the sound collected by the microphone.

Generally, the above mentioned conventional howling remover has only 5 through 9 number of the band pass filters in view of limitation by hardware construction. However, if an actual noise spectrum peak of the howling noise does not exactly coincide with one of the center frequencies of the band pass filters $13_1$–$13_n$, the remover cannot sufficiently remove the howling noise. Stated otherwise, the plurality of the fixed center frequencies of the BPF channels are set at a rather coarse pitch throughout the audible range, hence the actual howling frequency often fails inbetween to thereby fail to efficiently suppress the howling.

Further, as mentioned before, the microphone collects mixture of the direct and indirect sounds transmitted back from the loudspeaker. Particularly, in a relatively small listening room, the indirect sound exceeds a negligible level to cause complicated multiple reflection and interference. Consequently, the small ant closed room may exhibit a complicated frequency response which generates a plurality of noise spectrum peaks of the howling noise. In such a case, the conventional howling remover only carries out a band attenuation at a fixed and predetermined frequency band, thereby failing to sufficiently prevent the howling.

In order to obviate such a drawback, a great number of the band pass filters may be installed beyond the practical limitation of the hardware construction. However, as the number of the band pass filters increase, a Q value of each band pass filter must be raised so as to separate respective pass bands from each other. In such a case, as shown in FIG. 12, the band width of each band pass filter is certainly made narrow; however, a slope of the pass band is extended to a higher frequency range. Therefore, an averaged output level of the band pass filter does not significantly vary though a signal component significantly varies around a center frequency $f_0$ of the pass band. Stated otherwise, the sensitivity of the band pass filter to the signal is rather degraded as the Q value increases. Therefore, a loop gain of an audio amplification system could not be measured accurately, thereby failing to sufficiently prevent the howling.

Recently, a karaoke apparatus is rapidly popularized, hence there are many chances where the karaoke apparatus is installed in a narrow room together with a loudspeaker and a microphone. There is a keen demand to suppress the howling under such a room situation having a complicated frequency response.

SUMMARY OF THE INVENTION

In view of the above noted drawbacks of the prior art, an object of the invention is to provide a howling remover which can sufficiently prevent a howling noise even in a room having a complicated frequency response.

In a general form of the invention, an apparatus for amplifying a sound while suppressing a howling noise comprises collecting means for collecting a sound and for converting the collected sound into a corresponding input signal, generating means for amplifying the input signal to generate the sound, a plurality of attenuating means interposed between the collecting means and the generating means, each attenuating means having a variable attenuation frequency for attenuatively filtering the input signal around the attenuation frequency, detection means for detecting a plurality of noise spectrum peaks of the howling noise contained in the collected sound, and adjusting means for adjusting respective variable attenuation frequencies of the plurality of the attenuating means correspondingly to the plurality of the detected noise spectrum peaks to thereby remove the howling noise from the generated sound.

In a first specific form of an audio amplification system controlled by an operator and having sound collecting means for collecting a sound and for converting the collected sound into a corresponding input signal, and sound generating means including a loudspeaker for amplifying the input signal fed from the sound collecting means to generate the sound through the loudspeaker, the inventive howling prevention apparatus comprises a plurality of attenuating means interposed between the sound collecting means and the sound generating means, each attenuating means having a variable attenuation frequency adjustable for removing a howling noise having a plurality of noise spectrum peaks contained in the collected sound, operation means actuated by the operator for producing an operation signal, selection means actuated by the operator for selecting each of the attenuating means, and adjustment means for sweeping the variable attenuation frequency of the selected attenuating means in response to the operation signal so as to adjust the variable attenuation frequency to one of the noise spectrum peaks of the howling noise.

In a second specific form of an audio amplification system having sound collecting means for collecting a sound and for converting the collected sound into a corresponding input signal, and sound generating means including a loudspeaker for amplifying the input signal fed from the sound collecting means to generate the sound through the loudspeaker, the inventive howling prevention apparatus comprises white noise generating means for generating a white noise through the loudspeaker so as to intentionally introduce a test howling noise having a plurality of noise spectrum peaks into the collected sound, a plurality of attenuating means interposed between the sound collecting means and the sound generating means, each attenuating means having a variable attenuation frequency which can be automatically swept throughout an audible frequency range to attenuate the test howling noise, detection means for analyzing an output level of each attenuating means throughout the audible frequency range to detect an effective attenuation frequency of each attenuating means corresponding to one of the noise spectrum peaks, and adjustment means for adjusting each attenuating means to the detected effective attenuation frequency.

According to the first specific form, the operator manipulates the operation means so as to sweep the variable attenuation frequency of the attenuating means. Therefore, while the howling is intentionally generated, the operation means is manipulated to detect a frequency point at which the howling dumps. Then, the thus detected frequency point is set as the attenuation frequency of the attenuating means. Further, the plurality of the attenuating means are provided to achieve adaptive suppression of the howling having plural noise spectrum peaks within a listening room having a complicated frequency response. According to the second specific form, the detection means automatically detects a frequency corresponding to a noise spectrum peak of the white noise collected by the collecting means. The adjusting means sets the detected frequency to the attenuating means. In a preferred form, unless the specified sequence of the operation is conducted, the attenuation frequency is never changed in the attenuating means to thereby avoid inadvertent variation of the attenuation frequency.

DETAILED DESCRIPTION OF THE INVENTION

Figure 1:
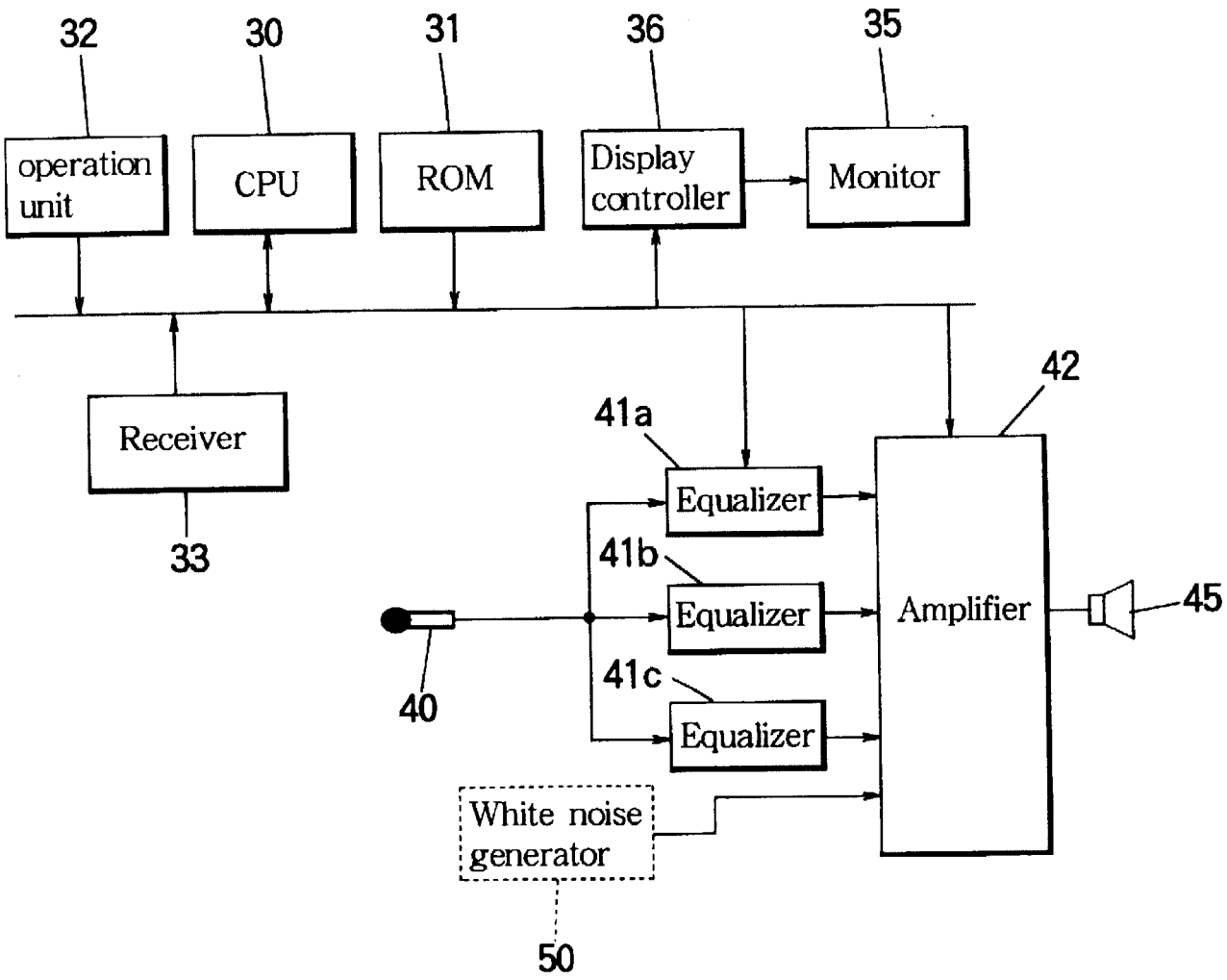
FIG. 1 is a structural block diagram showing a first embodiment of the inventive howling remover.

Hereinafter, a first embodiment of the present invention will be described in conjunction with the drawings. FIG. 1 is a block diagram showing an overall construction of the first embodiment of the invention. In this embodiment, the invention is applied to howling removal of a song accompaniment apparatus called "Karaoke". In the figure, a CPU 30 controls various components of the apparatus based on a program stored in a ROM 31. An operation unit or operation panel 32 has a power switch, a volume dial, a tone dial and other knobs for feeding operation signals to the CPU 30. A receiver 33 receives an input signal transmitted from a remote controller shown in FIG. 3.

Figure 3:
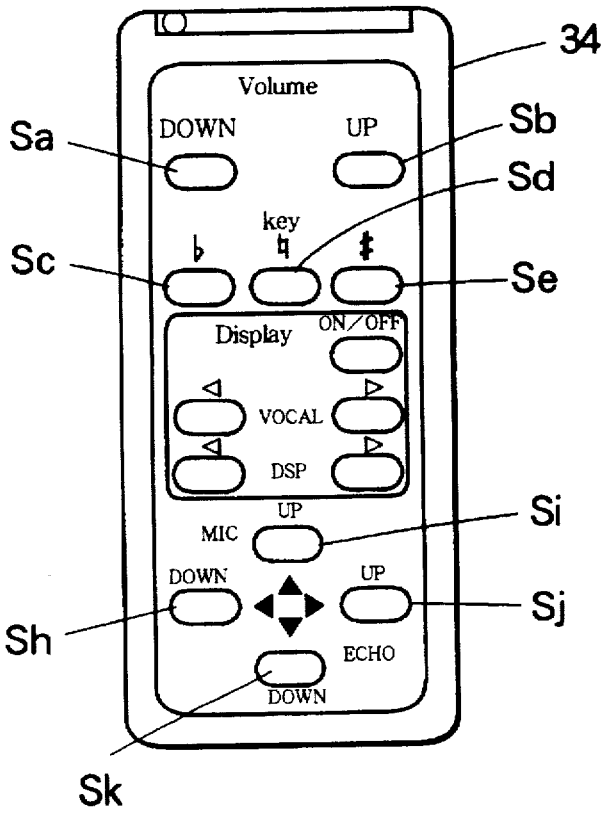
FIG. 3 is a front view showing an appearance of a remote controller used in the first embodiment.

Referring to FIG. 3, the remote controller 34 has similar functions as those of the operation unit 32, and produces an operation signal which is received by the receiver 33 and then fed to the CPU 30. The remote controller 34 is provided with various switches as described below. Switches Sa and Sb are provided to control a volume of a performance sound. The volume is decreased by depression of the switch Sa, while the volume is increased by depression of the other switch Sb. Switches Sc, Sd and Se are provided to control key of the performance, and are actuated to designate "half tone up", "natural" and "half tone down", respectively Switches Sh and Si are provided to control a microphone volume, and are actuated to command decrease and increase of the vocal volume, respectively. Switches Sk and Sj are provided to control an echo effect, and are actuated to command decrease and increase of the echo effect, respectively. These four switches Sh–Sk also function as direction keys, and indicate leftward, upward, rightward and downward directions, respectively. Further, the remote controller contains other switches used to command reproduction conditions of the karaoke performance. However, the karaoke performance reproduction is not related to the present invention, and therefore is not mentioned in detail.

Referring back to FIG. 1, a monitor 35 is composed of a CRT in this embodiment to display various information. The monitor 35 is controlled by a display controller 36 which operates under control by the CPU 30. Collecting means in the form of a microphone 40 collects a singing voice (vocal) to produce a corresponding input signal, which is fed to an amplifier 42 through parallel digital equalizers 41*a*, 41*b* and 41*c*. The amplified signal is outputted from a loudspeaker 45. Thus, the amplifier 42 and the loudspeaker 45 comprise means for generating a sound. The digital equalizers 41*a*, 41*b* and 41*c* have attenuation frequency responses separately adjustable by a control signal fed from the CPU 30.

Figure 2:
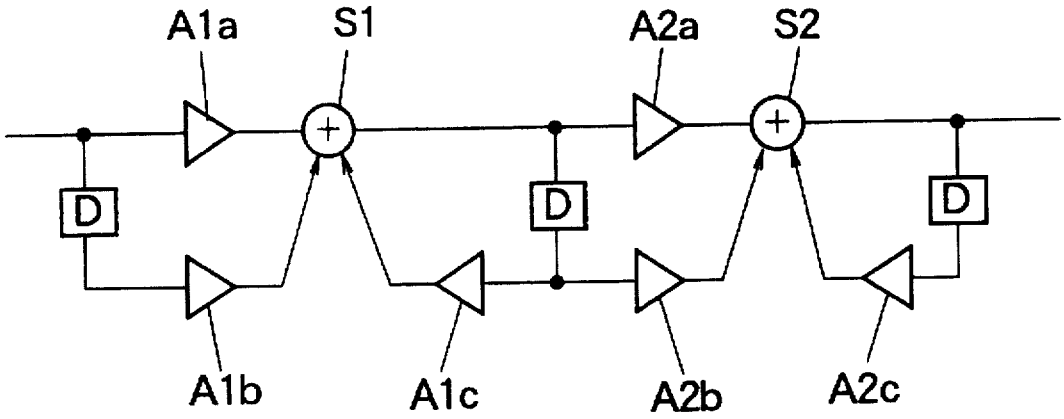
FIG. 2 is a block diagram showing a structure of a digital equalizer utilized in the first embodiment.

FIG. 2 is a block diagram showing a construction of the digital equalizers 41*a*, 41*b* and 41*c* having the same structure. In the figure, the equalizer has delay elements D, and adders S1 and S2. Further, amplifier elements A1*a*, A1*b* and A1*c* are provided to set a frequency response of a lower band. Amplifier elements A2*a*, A2*b* and A2*c* are provided to determine a frequency response of a higher band. A gain variation of the amplifier elements A1*c* and A2*c* dominantly influences a range variation of the lower and higher bands. A gain variation of the amplifier elements A1*a*, A1*b*, A2*a* and A2*b* dominantly influences an amplitude or output level variation of the respective bands. Therefore, the gains of the amplifier elements A1*a*, A1*b*and A1*c* are adjusted to set the frequency range and the output level of the lower band, while the gains of the amplifier elements A2*a*, A2*b* and A2*c* are adjusted to set the frequency range and the output level of the higher band. Accordingly, the digital equalizer functions as attenuating means in the form of a variable band attenuation filter to selectively attenuate a desired frequency range of the digital input signal. Importantly, the gains of the amplifier elements are variably adjusted to freely set a center attenuation frequency, an attenuation width and an attenuation depth. The attenuation width and the attenuation depth may be optimally fixed by initial setting, while the center attenuation frequency is adaptively controlled by the CPU 30.

Next, the description is given for operation of the first embodiment constructed as described above. First, specific operation is conducted according to a predetermined sequence on the operation unit 32 such as a power switch is actuated while a performance start switch is depressed. The CPU 30 detects such a specific sequence of the switch operation to set an installation mode. In this mode, various parameters and operation conditions are set in the karaoke apparatus. For example, the installation mode is executed to set a balance between left and right loudspeakers, to set tone of the musical sound, and to set sound image location of the vocal. The monitor 35 displays a menu list, to indicate setting items and contents in the installation mode.

Figure 4:
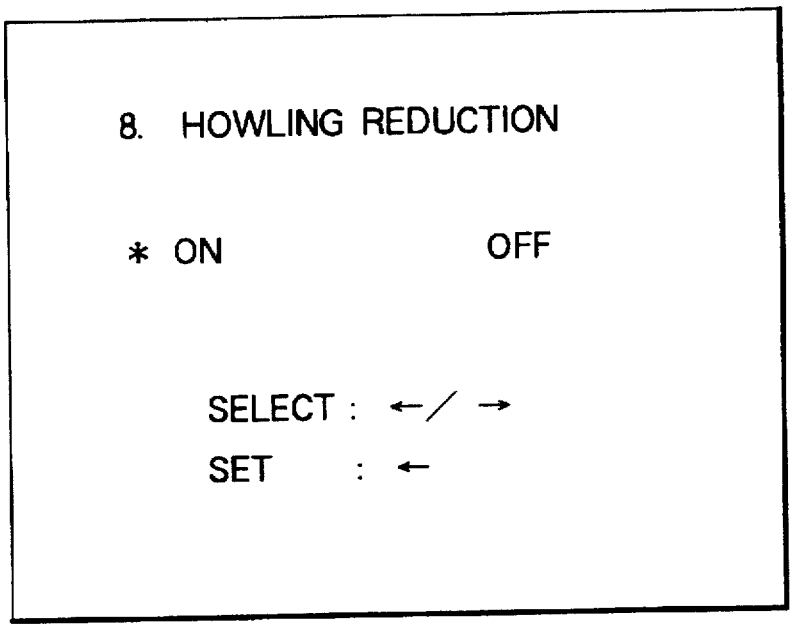
FIG. 4 shows a display screen of a monitor in the first embodiment.

While monitoring the menu screen, an operator actuates the operation unit 32 or the remote controller 34 to select a desired item. When an item "Howling reduction" is selected, the monitor 35 is switched to display a message screen as shown in FIG. 4. The screen indicates the message "8. HOWLING REDUCTION" at a top section. Consequently, the operator recognizes that the howling reduction setting mode is selected. The number "8" contained in the message indicates an eighth menu item. Then, the operator depresses either of the switch Sh (left arrow key) and the switch Sj (right arrow key) according to an instruction indicated at a second line of the screen from the bottom. In this case, a mark ON is selected upon depression of the switch Sh to indicate execution of the howling reduction. Another mark OFF is selected upon depression of the switch Sj to indicate canceling of the howling reduction. Further, the selected mark is labeled by a symbol "*". Upon the selection of ON, the monitor displays an instruction at the bottom line of the screen. This instruction suggests "Depress switch Sh when entering the setting operation".

Figure 5:
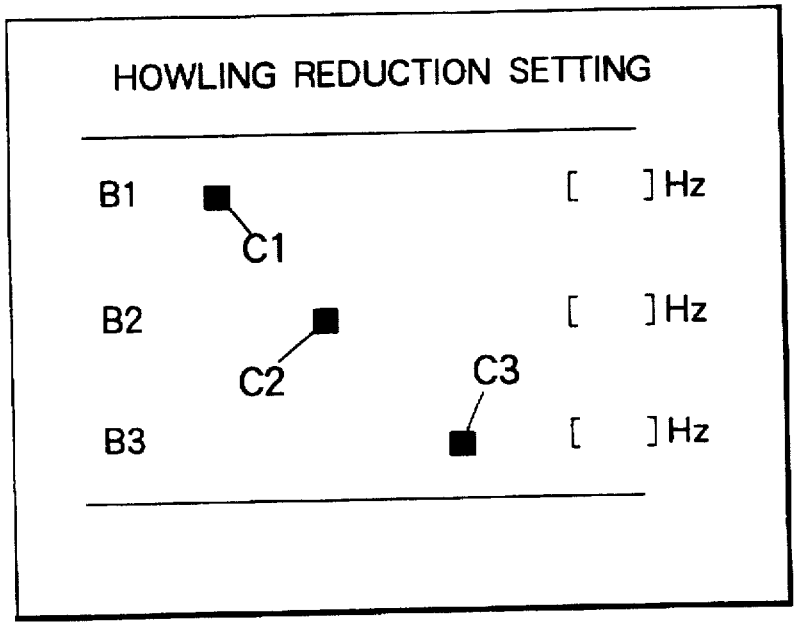
FIG. 5 shows another display screen of the monitor indicating howling reduction setting mode.

When the operator depresses the switch Sh, the CPU 30 detects this to feed a control signal to the display controller 36 so that the monitor 35 is switched to display a next message screen as shown in FIG. 5. This screen indicates a message "HOWLING REDUCTION SETTING" at the top line, thereby notifying the entering into the setting process to the operator. Further, three rows of B1, B2 and B3 are displayed on a central section of the screen. These three rows indicate attenuation frequencies of channels B1, B2 and B3, which correspond to the respective digital equalizers 41*a*, 41*b* and 41*c* shown in FIG. 1.

While monitoring the screen shown in FIG. 5, either of the switch Si (up arrow key) and the switch Sk (down arrow key) is depressed to designate an active one from the three channels B1, B2 and B3. In response, the CPU 30 selects one of the digital equalizers 41*a*, 41*b* and 41*c* corresponding to the active channel, a center attenuation frequency of which is to be adjusted. Lastly, the howling reduction setting mode is ended when the switch Si is depressed while the channel B1 is selected or when the switch Sh is depressed while the channel B3 is selected.

In the adjustment process under the howling reduction setting mode, a volume dial of the operation unit 32 is rotated to boost the sound volume so that the CPU 30 increases the gain of the power amplifier 42. Howling starts to occur as the gain is gradually raised. Under the state where the howling is intentionally generated, the operator selects one of the channels B1–B3, which arc indicated on the FIG. 5 screen of the monitor 35. For example, the first channel B1 is activated to select the first digital equalizer 41*a*. Then, either of the switch Sh (←) and the switch Sj (→) is depressed. In response to this operation, a cursor C1 moves leftward or rightward along the active channel B1 shown on the screen of FIG. 5. In synchronization to the movement of the cursor C1, the CPU 30 sweeps the attenuation frequency of the digital equalizer 41*a*. Further, a value of the current attenuation frequency is indicated at a space of [ ] Hz at the row of the channel B1. By such a manner, the attenuation frequency is swept to enable the operator to auditorily examine how a howling noise varies. By this, the operator detects a point at which the howling noise significantly falls. The operator confirms the value of the attenuation frequency at the point from the display. Further, the same operation is conducted for the remaining channels B2 and B3 such as to detect points where the howling noise falls or reduces while sweeping or scanning the cursors C2 and C3 throughout an audible frequency range. Generally, the howling is generated at a plurality of noise spectrum points so that the respective channels are adjusted to different attenuation frequencies. After the adjustment of the three channels B1 B2 and B3 is completed, the howling reduction mode is ended. As a consequence of the above mentioned process, the digital equalizers 41*a*, 41*b* and 41*c* are set to separate attenuation frequencies effective to efficiently attenuate or dump the plurality of the noise spectrum peaks of the howling noise.

Next, the description is given for a second embodiment where the howling reduction setting is carried out automatically. The second embodiment has basically the same structure as that of the first embodiment. The second embodiment is additionally provided with a white noise generator 50 indicated as a dashed block of FIG. 1. The white noise generator 50 is operated by the CPU 30 to generate a white noise which is fed to the amplifier 42.

Figure 6:
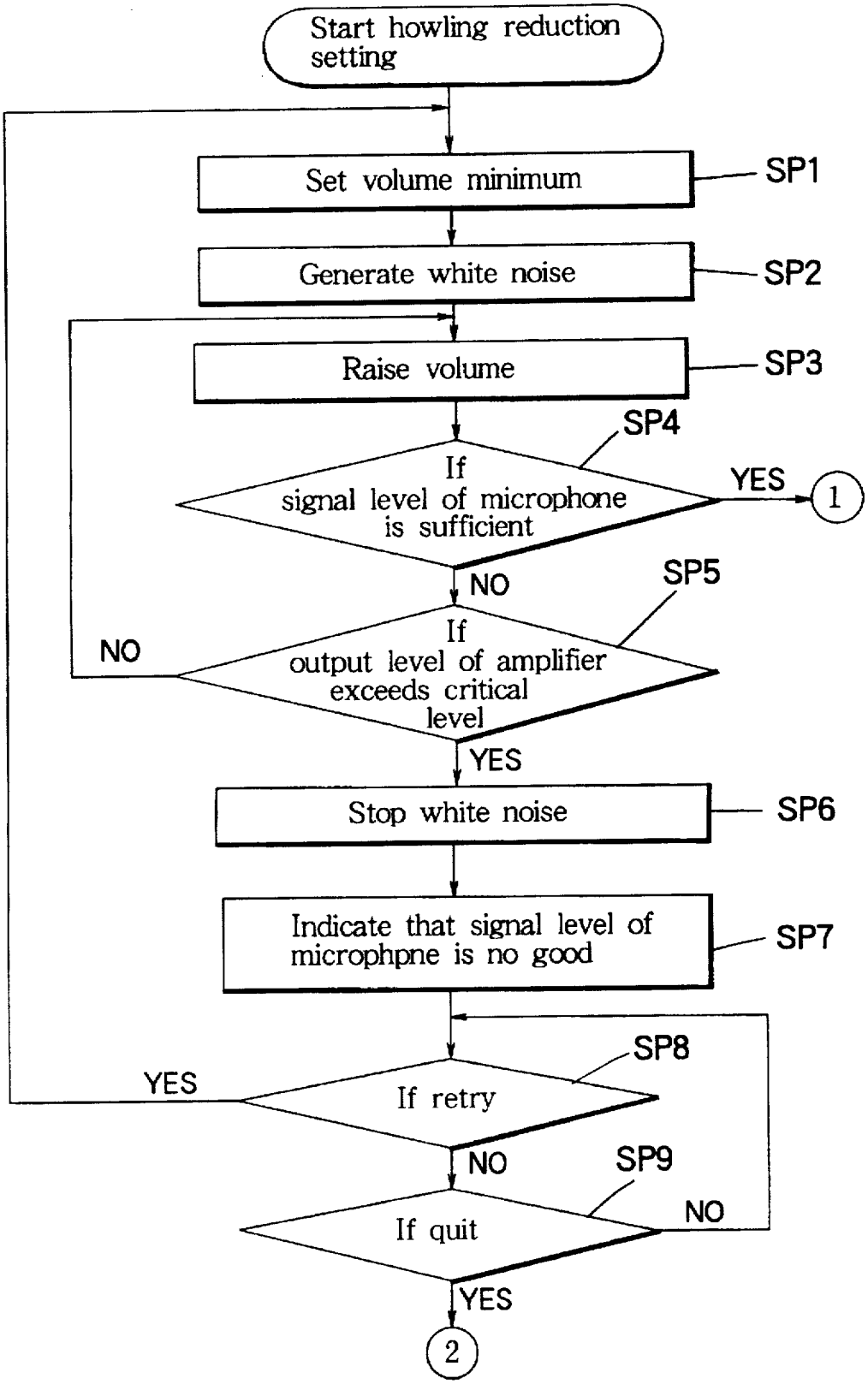
FIG. 6 is a flowchart showing operation of a second embodiment of the inventive howling remover.
Figure 7:
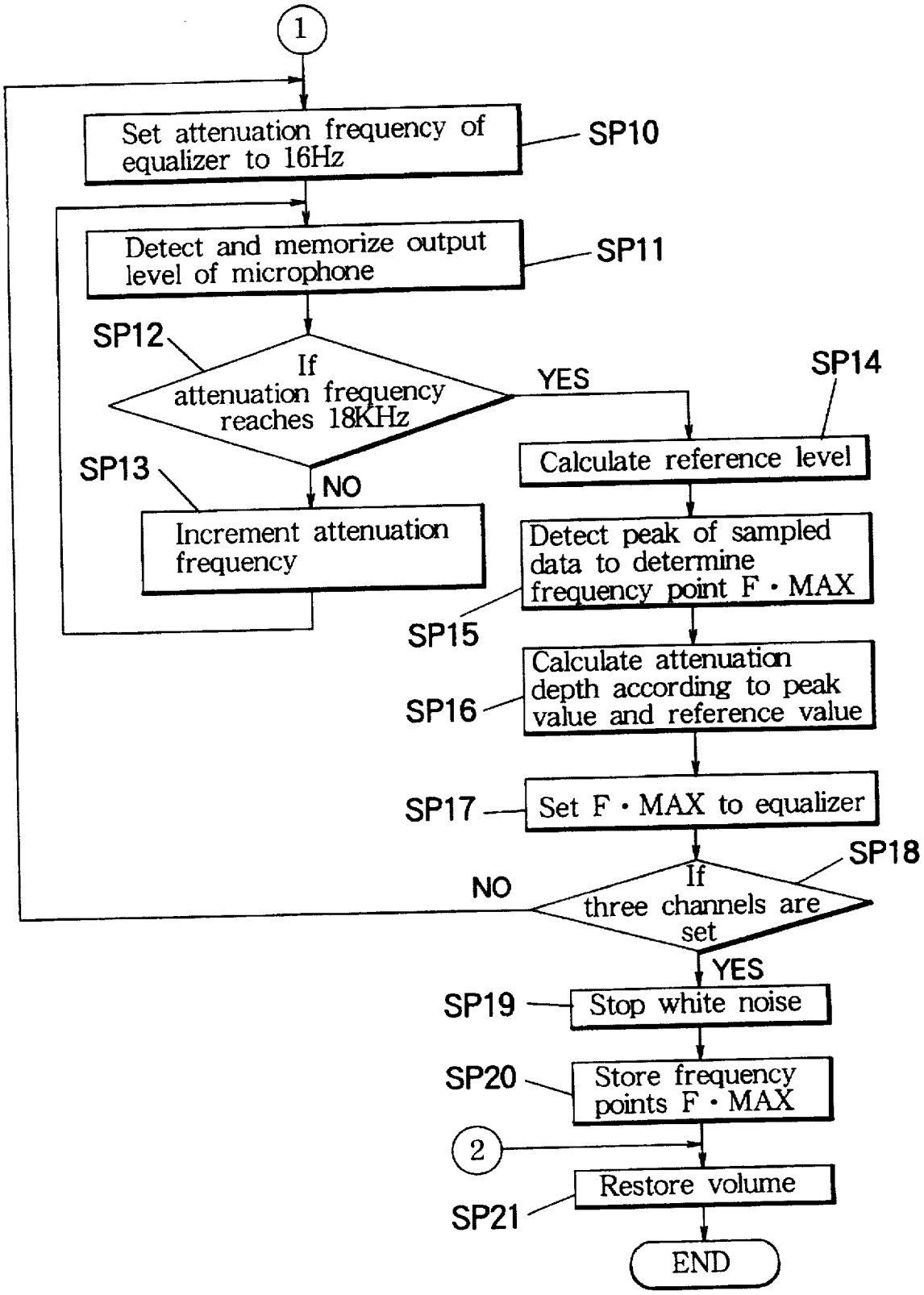
FIG. 7 is another flowchart showing operation of the second embodiment.

The attenuation frequencies of the digital equalizers 41*a*, 41*b* and 41*c* are automatically adjusted in this embodiment as follows. Upon selection of the attenuation frequency adjustment mode, a subroutine is called as shown in FIGS. 6 and 7. First, a volume of the amplifier 42 is set to a minimum level at step SP1 shown in FIG. 6. Then, the white noise generator 50 is activated at step SP2 to generate a white noise. Subsequently at step SP3, the volume of the amplifier 42 is raised by a given degree. Concurrently, check is made at step SP4 as to if a signal level of the microphone 40 is sufficient. If this check result is NO, subsequent check is made at step SP5 as to if the output level of the amplifier 42 exceeds a critical level. If the check result is NO, the routine backs to the step SP3. Thereafter, the cycle of the steps SP3—SP5 is repeated until the signal level of the microphone reaches the sufficient degree. During the repetition of the cycle, if the check result of the step SP5 turns YES, the white noise generator 50 is stopped at step SP6. Further, the monitor 35 indicates that the signal level of the microphone 40 is no good at step SPT. By such a manner, in case that the routine advances to step SP7, it is indicated that the microphone 40 is deflective or inadvertently disconnected from the apparatus. Then, judgement is made at step SP8 as to if retry is requested. The retry request is inputted by means of a specified switch in the operation unit 32. If this judgement is NO, subsequent judgement is made at step SP9 as to if an exit command is issued to quit the process. The exit command is inputted by a specified switch in the operation unit 32. If the judgement of steps SP8 and SP9 is NO, the routine is held in waiting state until the judgement turns to YES at either of the steps SP8 and SP9. Then, if the retry is requested, the routine returns to the step SP1 to start the above noted process again. If the exit command is inputted, the routine jumps to step SP21 of FIG. 7 where the volume of the amplifier is returned to an original level before the subroutine is commenced, thereby finishing the process.

On the other hand, if the microphone level is sufficient, the judgement of step SP4 is YES, and the routine proceeds to step SP10 of FIG. 7. In this step SP10, the digital equalizer 41*a* is initially selected and its attenuation frequency is set to 16 Hz. Then, the output level of the microphone 40 is detected and memorized at step SP11. Further, check is made at step SP12 as to if the set, attenuation frequency reaches 18 kHz. If NO, the attenuation frequency is increased by a predetermined pitch at step SP13, thereby returning to the step SP11. Thereafter, the cycle of the steps SP11–SP13 is repeatedly carried out until the check result turns YES at the step SP12. Consequently, the attenuation frequency is swept from 16 Hz to 18 kHz throughout the audible range so as to stepwise sample the output level of the microphone 40.

Then, the scanned attenuation frequency reaches 18 kHz so that the judgement of the step SP12 turns YES. Subsequently, the routine branches to step SP14 where a mean or reference level is calculated according to the sampled values. Next, the routine advances to step SP15 where a maximum or peak of the sampled data is detected to determine a frequency point F·MAX at which a significant attenuation effect is observed. Additionally, an attenuation depth is calculated according to the peak value and the mean value at step SP16. Further, the attenuation frequency of the digital equalizer 41*a* is set to F·MAX. Then, check is made at step SP18 as to if the setting of the three channels is completed. If NO, the next digital equalizer 41*b* is selected. Then, the routine backs to the step SP10, thereby executing the similar process. By such a manner, the setting of the attenuation frequency is completed for all of the digital equalizers 41*a*, 41*b* and 41*c*. Consequently, the judgement of the step SP18 turns YES, so that the white noise generator 50 is stopped at step SP19. Then, step SP20 is undertaken to store or reserve the attenuation frequencies of the respective digital equalizers 41*a*, 41*b* and 41*c*. Lastly, the volume of the amplifier is restored to the initial value at step SP21, thereby ending the operation.

Figure 8:
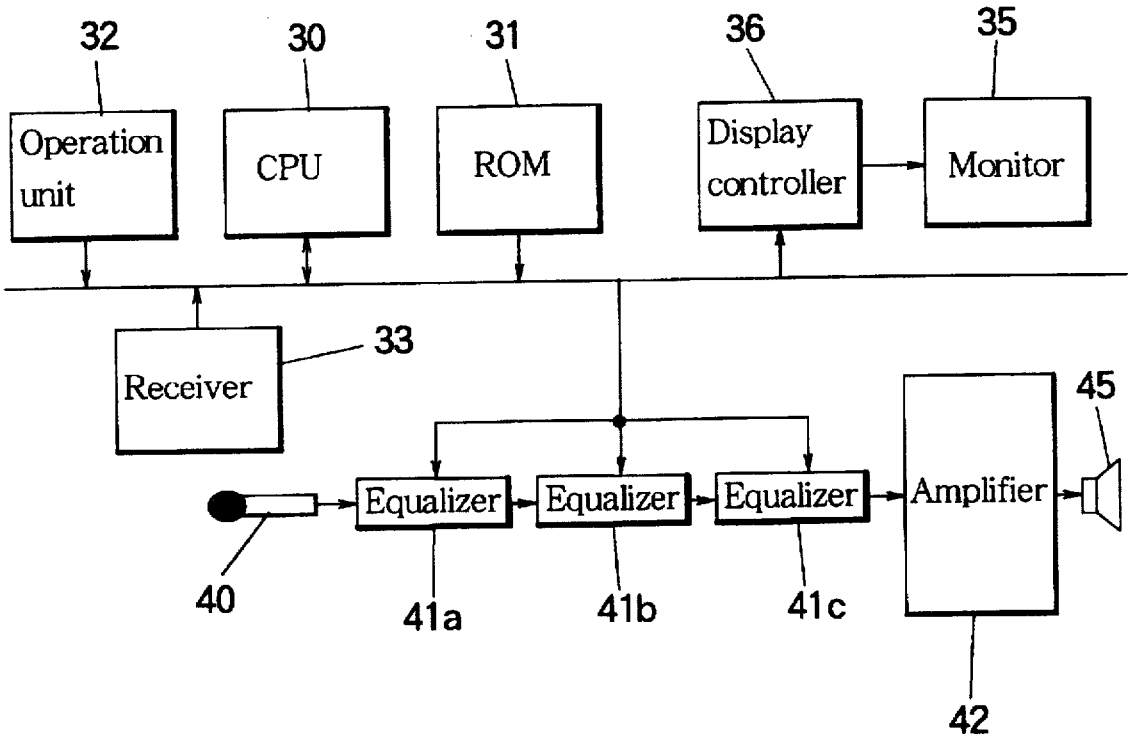
FIG. 8 is a structural block diagram showing a third embodiment of the inventive howling remover.

Next, description is given for a third embodiment. FIG. 8 is a block diagram showing an overall construction of the third embodiment. This embodiment is different from the first, embodiment in structure and connection of digital equalizers 41*a*, 41*b* and 41*c*.

Figure 9:
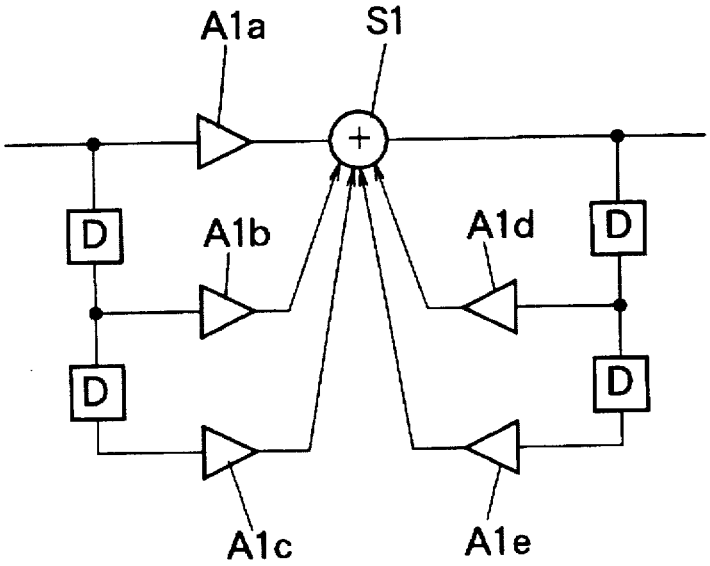
FIG. 9 is a block diagram showing a structure of a digital equalizer utilized in the third embodiment.

These digital equalizers 41*a*, 41*b* and 41*c* have a common structure as shown in FIG. 9. In the figure, the digital equalizer is comprised of amplifier elements A1*a*–A1*e*, an adder S1 and delay elements D to constitute a band attenuation filter. In such a construction, gains of the amplifier elements A1*a*–A1*e* are adjusted to freely determine a center attenuation frequency, an attenuation band width and an attenuation depth of the digital equalizer. The band width and the attenuation depth are provisionally set to desired values, while the center frequency of the attenuation band is controlled by the CPU 30. Further, as shown in FIG. 8, the digital equalizers 41*a*, 41*b* and 41*c* are connected in series to each other.

This embodiment executes the shift to the howling reduction setting mode and conducts the adjustment process in the howling reduction setting mode in manner similar to the first embodiment. However, in the third embodiment, the input signal from the microphone is sequentially attenuated by the series of the digital attenuators 41*a*, 41*b* and 41*c* at different frequency bands corresponding to noise spectrum peaks of howling noise before entering into the output amplifier 42. On the other hand, in the previous first and second embodiments, the input signal from the microphone is attenuated at different bands in parallel manner, and is then outputted to the amplifier 42 for synthesis. Accordingly, a level of the attenuated band is made lower than those of the non-attenuated bands. Namely, the attenuation is carried out a band by band through the respective digital equalizers 41*a*–41*c*.

Figure 10:
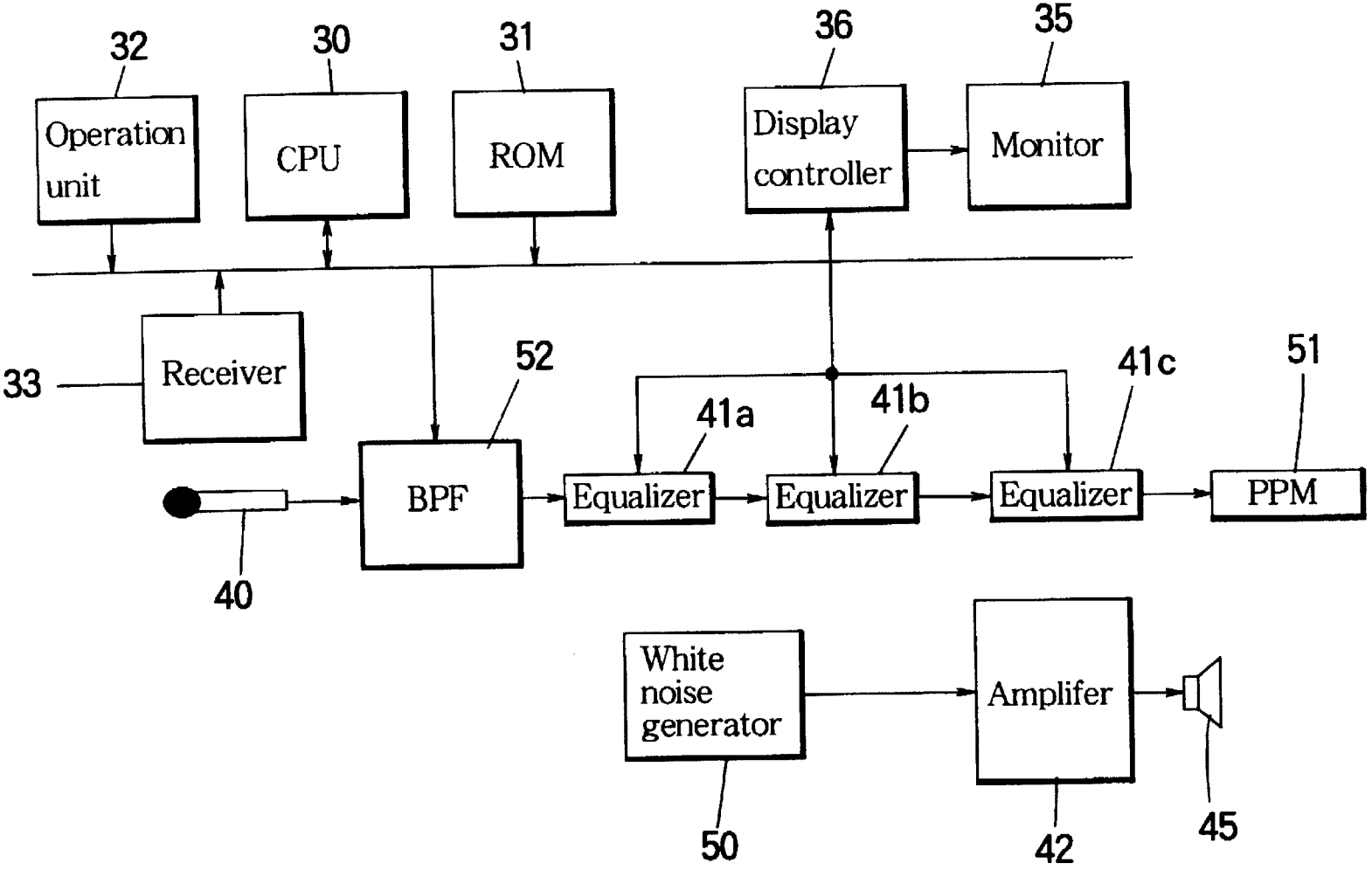
FIG. 10 is a structural block diagram showing a fourth embodiment of the inventive howling remover under adjustment state.
Figure 11:
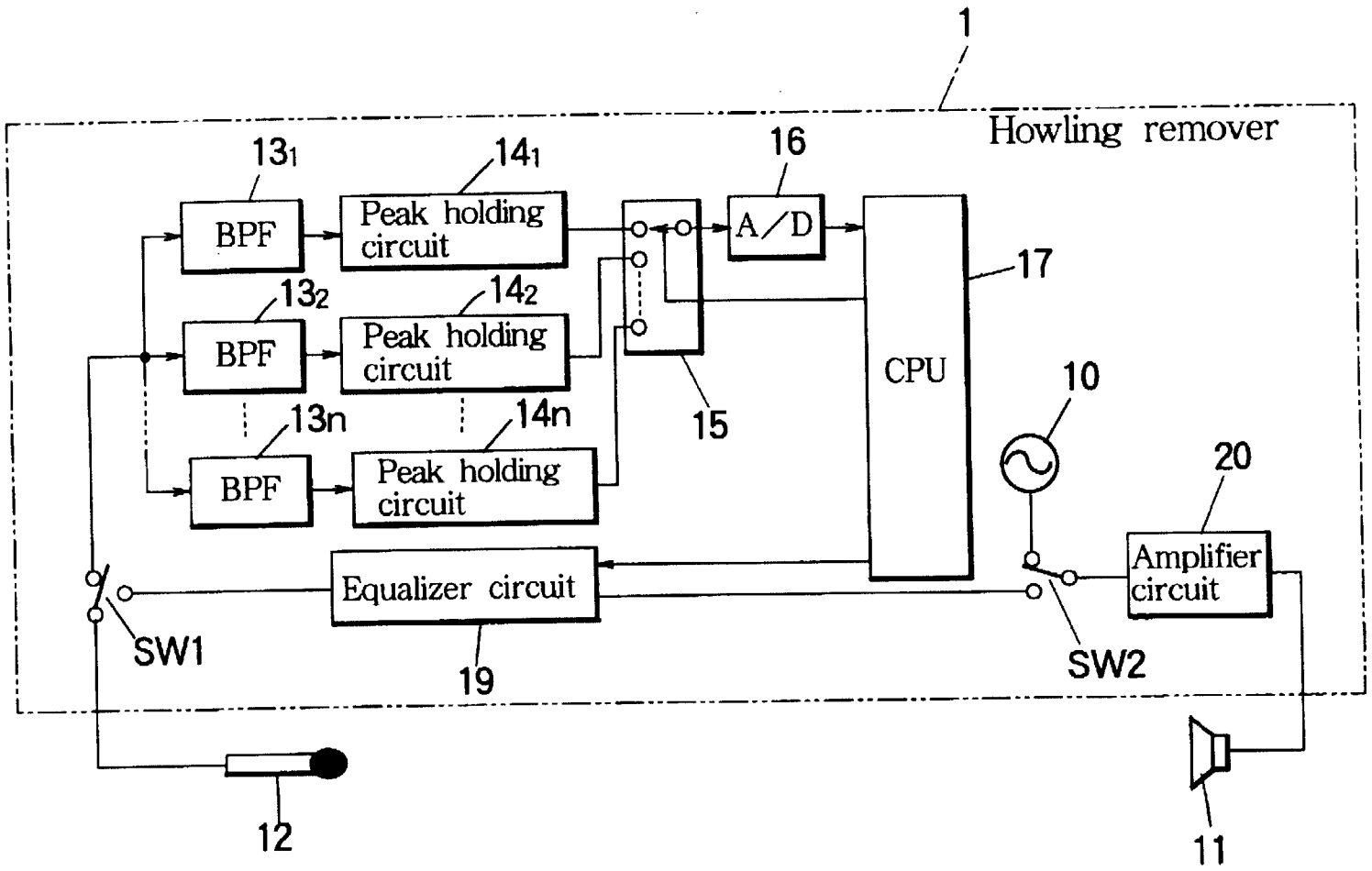
FIG. 11 PRIOR ART
FIG. 11 is a block diagram showing a structure of a conventional howling remover.
Figure 12:
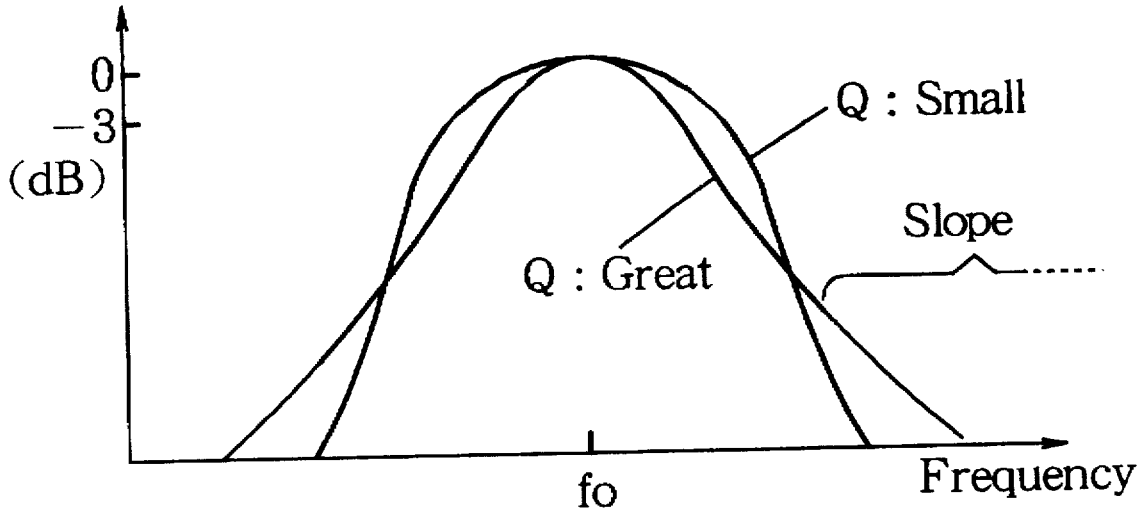
FIG. 12 PRIOR ART
FIG. 12 is a diagram showing a characteristic curve of a band pass filter.

Next, a fourth embodiment is described in conjunction with FIG. 10. This embodiment is different from the second embodiment in the following aspects. First, the equalizers 41*a*, 41*b* and 41*c* are connected in series. Second, the noise signal of the white noise generator 50 is sounded from the loudspeaker 45 through the amplifier 42. Third, a peak program meter 51 is connected to an output terminal of the last digital equalizer 41*c*. Fourth, a band pass filter 52 is interposed between the microphone 40 and the first digital equalizer 41*a*.

Next, the description is given for the operation of the fourth embodiment. This embodiment executes the adjustment of the attenuation frequency responses of the digital equalizers 41*a*, 41*b* and 41*c* in manner similar to the second embodiment according to the steps shown in the flowchart of FIGS. 6 and 7. However, the process is modified in minor respect due to the structural difference. Namely, the steps shown in FIG. 6 are executed exactly in the same manner, while the subroutine shown in FIG. 7 is modified as follows. First, in the step SP10, a center pass frequency of the variable band pass filter 52 is initially set to 16 Hz by the CPU 30. Then, in the step SP11, the output level of the microphone is sampled and memorized by the PPM 51 while the equalizers 41*a*41*c* are placed in a through state. Further, check is made in the step SP12 as to if the center frequency of the band pass filter 52 reaches 18 kHz. If NO, the center frequency is raised by a given pitch at the step SP13, thereby returning to the step SP11. Thereafter, the cycle of the steps SP11—SP13 is repeatedly executed until the check result of the step SP12 turns YES. Consequently, the output level of the microphone 40 is sampled throughout the audible frequency range of 16 Hz to 18 kHz.

The check result of the step SP12 is turned YES when the stepwise sweeping of the center frequency reaches 18 kHz. Then, the routine advances to the step SP14 where a mean or reference value of the microphone output level is calculated according to the sampled data. Further, in the step SP15, the peak program meter 51 determines a peak frequency point F·MAX at which the microphone output level reaches a peak or maximum value. Thus, the attenuation frequency (center frequency) of the digital equalizer 41*a* is set to F·MAX. Subsequently, check is made at the step SP18 as to if the setting of the three bands is all completed. If NO, the next digital equalizer 41*b* is selected, and the routine returns to the step SP10 to thereby execute the similar process as described above. In such a case, since the noise spectrum peak of the microphone output level at the first, detected frequency point is suppressed by the attenuation operation of the digital equalizer 41*a*, a second frequency point F·MAX is detected at another noise spectrum peak of the sampled data.

By such a manner, the respective points are detected for all of the digital equalizers 41*a*, 41*b* and 41*c* so that the attenuation frequencies of the three channels are set. Consequently, the check result of the step SP18 turns YES. Then, the white noise generator 50 is stopped or silenced at the step SP19. Then, the step SP20 is undertaken to store the values of the attenuation frequencies of the respective digital equalizers 41*a*, 41*b* and 41*c*. Lastly, the volume of the output amplifier is restored to the initial value at the step SP21, thereby finishing the adjustment operation.

Next, the connection of the fourth embodiment is switched from the initial state of FIG. 10 to the normal state of FIG. 8. This connection switching is executed under the control by the CPU 30. Namely, the components of the apparatus can be interconnected in two ways switchably between the FIG. 10 initial state and the FIG. 8 normal state. When the apparatus is switched to the FIG. 8 normal state, the while noise generator 50 is decoupled from the amplifier 42 while the last, digital equalizer 41*c* is coupled to the amplifier 42. Further, the band pass filter is disconnected. Then, the values stored by the step SP20 arc set into the respective digital equalizers 41*a*, 41*b* and 41*c*. By this, the digital equalizers 41*a*, 41*b* and 41*c* can efficiently attenuate or remove the howling at the most significant points where the howling tends to occur. As described above, the fourth embodiment utilizes the peak program meter 51 which is functionally divided out from the CPU 30 of the second embodiment. Further, the variable band pass filter 52 is utilized to detect the frequency point F·MAX, i.e., the noise spectrum peak of the howling noise.

There are variations of the invention as follows.

(1) Though the remote controller 34 is operated to adjust the attenuation frequencies of the digital equalizers 41*a*, 41*b* and 41*c*, a manual dial or the like may be provided on the operation unit 32 in place of the remote controller so as to adjust the frequency response of each equalizer.

(2) The digital equalizer used in the respective embodiments may have a circuit structure other than the FIGS. 2 and 9 circuits. It is essential to use the circuit constructed to vary the attenuation frequency.

(3) Though the frequency points at which the microphone output level reaches peaks are sequentially assigned to the digital equalizers 41*a*, 41*b* and 41*c* in the second embodiment, the assignment order is not limited to this. It is essential to detect frequency points corresponding to three of the most significant noise spectrum peaks of the microphone output level.

(4) The number of the digital equalizers (attenuating means) is not listed to three as in the embodiments, but can be suitably set as desired or required.

(5) It is preferable to enter the howling reduction setting mode upon specific manipulation of the operation panel in the second, third and fourth embodiments likewise the first embodiment.

(6) Though the maximum peak value is detected at the steps SP15–SP17 in the fourth embodiment, a plurality of peak values may be concurrently detected. Then, three of the most significant peaks are selected, and corresponding frequency points are assigned to the digital equalizers 41*a*, 41*b* and 41*c*.

As described above, according to the invention, the howling can be sufficiently suppressed or removed even in a room having a complicated frequency response. Further, unless the specific manipulation is conducted in the operation unit, the adjustment of the attenuation frequency is inhibited to thereby prevent inadvertent change of the once set attenuation frequency. Moreover, while the white noise is intentionally generated, the CPU automatically detects a frequency corresponding to a peak of a signal level of a test, sound collected by the microphone. The detected frequency is set in the attenuation means to thereby achieve automatic setting of the attenuation frequency response of the equalizer.

What is claimed is:

1. An apparatus for amplifying a sound while suppressing a howling noise, the apparatus comprising:

collecting means for collecting a sound and for converting the collected sound into a corresponding input signal;

generating means for amplifying the input signal to generate the sound;

a plurality of attenuating means interposed between the collecting means and the generating means, each attenuating means each attenuating means being comprised of a digital equalizer having a variable attenuation frequency for attenuating filtering the input signal around the attenuation frequency;

detection means operative to individually sweep variable attenuation frequencies of the plurality of the digital equalizers for detecting a plurality of noise spectrum peaks of the howling noise contained in the collected sound; and adjusting means for adjusting respective variable attenuation frequencies of the plurality of the attenuating means corresponding to the plurality of the detected noise spectrum peaks to remove the howling noise from the generated sound.

2. An apparatus according to claim 1, wherein the detection means comprises automatic sweeping means for automatically sweeping the variable attenuation frequency of each attenuating means throughout an audible frequency range, and automatic analyzing means for analyzing an output level of each attenuating means throughout the audible frequency range to detect a noise spectrum peak of the howling noise.

3. An apparatus according to claim 1, including white noise source means coupled to the generating means for generating a white noise effective to intentionally introduce the howling noise into the collected sound to thereby enable the detection means to detect the plurality of the noise spectrum peaks of the howling noise.

4. An apparatus according to claim 1, including permission means activated only by a specified sequence of manual operation for permitting the adjusting means to adjust the variable attenuation frequency of each attenuating means.

5. An apparatus according to claim 1, wherein the plurality of the attenuating means comprises a plurality of digital equalizers connected in parallel to each other between the collecting means and the generating means for attenuating the plurality of the noise spectrum peaks in a parallel manner.

6. An apparatus according to claim 1, wherein the plurality of the attenuating means comprises a plurality of digital equalizers connected in series to each other between the collecting means and the generating means for attenuating the plurality of the noise spectrum peaks in a serial manner.

7. An apparatus for amplifying a sound while suppressing a howling noise, the apparatus comprising:

collecting means for collecting a sound and for converting the collected sound into a corresponding input signal;

generating means for amplifying the input signal to generate the sound;

a plurality of attenuating means interposed between the collecting means and the generating means, each attenuating means having a variable attenuation frequency for attenuating filtering the input signal around the attenuation frequency;

detection means for detecting a plurality of noise spectrum peaks of the howling noise contained in the collected sound; and adjusting means for adjusting respective variable attenuation frequencies of the plurality of the attenuating means corresponding to the plurality of the detected noise spectrum peaks to remove the bowling noise from the generated sound, wherein the detection means comprises a display and manual sweeping means manipulated by an operator to sweep the variable attenuation frequency of each attenuating means throughout an audible frequency range while the operator auditorily examines the generated sound so that a noise spectrum peak can be audibly detected and confirmed by the operator when the howling noise contained in the generated sound is significantly changed.

8. An apparatus for amplifying a sound while suppressing a howling noise, the apparatus comprising:

collecting means for collecting a sound and for converting the collected sound into a corresponding input signal;

generating means for amplifying the input signal to generate the sound;

a plurality of attenuating means interposed between the collecting means and the generating means, each attenuating means having a variable attenuation frequency for attenuating filtering the input signal around the attenuation frequency;

detection means for detecting a plurality of noise spectrum peaks of the howling noise contained in the collected sound; and adjusting means for adjusting respective variable attenuation frequencies of the plurality of the attenuating means corresponding to the plurality of the detected noise spectrum peaks to remove the howling noise from the generated sound, wherein the detection means comprises a band pass filter provided separately from the attenuating means and having a variable center frequency which can be swept to selectively filter the input signal around the variable center frequency, and analyzing means for analyzing the filtered input signal to detect noise spectrum peaks of the howling noise contained in the collected sound.

9. In an audio amplification system controlled by an operator and having sound collecting means for collecting a sound and for converting the collected sound into a corresponding input signal, and sound generating means including a loudspeaker for amplifying the input signal fed from the sound collecting means to generate the sound through the loudspeaker, a howling prevention apparatus comprising:

a plurality of attenuating means interposed between the sound collecting means and the sound generating means, each attenuating means having a variable attenuation frequency adjustable for removing a howling noise having a plurality of noise spectrum peaks contained in the collected sound;

operation means actuated by the operator for producing an operation signal;

selection means actuated by the operator for selecting each of the attenuating means; and adjustment means by the sweeping the variable attenuation frequency of the selected attenuating means in response to the operation signal so as to adjust the variable attenuation frequency to one of the noise spectrum peaks of the howling noise.

10. The howling prevention apparatus according to claim 9, further including permission means having a manual piece and being activated only when the manual piece is actuated by the operator according to a specified sequence for enabling the operation means and the selection means.

11. In an audio amplification system having sound collecting means for collecting a sound and for converting the collected sound into a corresponding input signal, and sound generating means including a loudspeaker for amplifying the input signal fed from the sound collecting means to generate the sound through the loudspeaker, a howling prevention apparatus comprising:

white noise generating means for generating a white noise through the loudspeaker so as to intentionally introduce a test howling noise having a plurality of noise spectrum peaks into the collected sound;

a plurality of attenuating means interposed between the sound collecting means and the sound generating means, each attenuating means having a variable attenuation frequency which can be automatically swept throughout an audible frequency range to attenuate the test howling noise;

detection means for analyzing an output level of each attenuating means throughout the audible frequency range to detect an effective attenuation frequency of each attenuating means corresponding to one of the noise spectrum peaks; and adjustment means for adjusting each attenuating means to the detected effective attenuation frequency.

12. The howling prevention apparatus according to claim 11, further including permission means having a manual piece and being activated only when the manual piece is actuated according to a specified sequence for enabling the detection means and the adjustment means.

13. In an audio amplification system controlled by an operator and having a sound collecting circuit that collects a sound and for converting the collected sound into a corresponding input signal, and a sound generating circuit that includes a loudspeaker to amplify the input signal fed from the sound collecting circuit to generate the sound through the loudspeaker, a howling prevention apparatus comprising:

a plurality of attenuating circuits interposed between the sound collecting circuit and the sound generating circuit, each attenuating circuit having a variable attenuation frequency that is adjustable to remove a howling noise having a plurality of noise spectrum peaks contained in the collected sound;

an operation circuit that is actuated by the operator to produce an operation signal;

a selection circuit that is actuated by the operator to select one of the attenuating circuits; and an adjustment circuit that sweeps the variable attenuation frequency of the selected one attenuating circuit in response to the operation signal to adjust the variable attenuation frequency to one of the noise spectrum peaks of the howling noise.

14. The howling prevention apparatus according to claim 13, further including a permission circuit having a manual piece and being activated only when the manual piece is actuated by the operator according to a specified sequence for enabling the operation circuit and the selection circuit.

15. In an audio amplification system having a sound collecting circuit that collects a sound and which converts the collected sound into a corresponding input signal, and a sound generating circuit that includes a loudspeaker for amplifying the input signal fed from the sound collecting circuit to generate the sound through the loudspeaker, a howling prevention apparatus comprising:

a white noise generating circuit that generates white noise through the loudspeaker to intentionally introduce a test howling noise having a plurality of noise spectrum peaks into the collected sound; pl a plurality of attenuating circuits interposed between the sound collecting circuit and the sound generating circuit, each attenuating circuit having a variable attenuation frequency which can be automatically swept throughout an audible frequency range to attenuate the test howling noise;

a detection circuit that analyzes an output level of each attenuating circuit throughout the audible frequency range to detect an effective attenuation frequency of each attenuating circuit corresponding to one of the noise spectrum peaks; and an adjustment circuit that adjusts each attenuating circuit to the detected effective attenuation frequency.

16. The howling prevention apparatus according to claim 15, further including a permission circuit having a manual piece and being activated only when the manual piece is actuated according to a specified sequence for enabling the detection circuit and the adjustment circuit.

17. An apparatus for amplifying a sound while suppressing a howling noise, the apparatus comprising:

a collecting circuit that collects a sound and converts the collected sound into a corresponding input signal;

a generating circuit that amplifies the input signal to generate the sound;

a plurality of attenuating circuits interposed between the collecting circuit and the generating circuit, each attenuating circuit being composed of a digital equalizer that has a variable attenuation frequency for attenuating filtering the input signal around the attenuation frequency;

a detection circuit operative to individually sweep variable attenuation frequencies of the plurality of the digital equalizers to detect a plurality of noise spectrum peaks of the howling noise contained in the collected sound; and an adjusting circuit to adjust respective variable attenuation frequencies of the plurality of the attenuating circuits corresponding to the plurality of the detected noise spectrum peaks to remove the howling noise from the generated sound.

18. An apparatus for amplifying a sound while suppressing a howling noise, the apparatus comprising:

a collecting circuit that collects a sound and converts the collected sound into a corresponding input signal;

a generating circuit that amplifies the input signal to generate the sound;

a plurality of attenuating circuits interposed between the collecting circuit and the generating circuit, each attenuating circuit having a variable attenuation frequency for attenuating filtering the input signal around the attenuation frequency;

a detection circuit that detects a plurality of noise spectrum peaks of the howling noise contained in the collected sound; and an adjusting circuit that adjusts respective variable attenuation frequencies of the plurality of the attenuating circuits corresponding to the plurality of the detected noise spectrum peaks to remove the howling noise from the generated sound, wherein the detection circuit comprises a manual sweeping circuit manipulated by an operator to sweep the variable attenuation frequency of each attenuating circuit throughout an audible frequency range while the operator auditorily examines the generated sound so that a noise spectrum peak can be audibly detected when the howling noise contained in the generated sound is significantly changed.

19. An apparatus for amplifying a sound while suppressing a howling noise, the apparatus comprising:

a collecting circuit that collects a sound and converts the collected sound into a corresponding input signal;

a generating circuit that amplifies the input signal to generate the sound;

a plurality of attenuating circuits interposed between the collecting circuit and the generating circuit, each attenuating circuit having a variable attenuation frequency for attenuating filtering the input signal around the attenuation frequency;

a detection circuit that detects a plurality of noise spectrum peaks of the howling noise contained in the collected sound; and an adjusting circuit that adjusts respective variable attenuation frequencies of the plurality of the attenuating circuits corresponding to the plurality of the detected noise spectrum peaks to remove the howling noise from the generated sound, wherein the detection means comprises a band pass filter provided separately from the attenuating means and having a variable center frequency which can be swept to selectively filter the input signal around the variable center frequency, and analyzing means for analyzing the filtered input signal to detect noise spectrum peaks of the howling noise contained in the collected sound.

* * * * *